US005260755A

United States Patent [19]

Imaizumi

[11] Patent Number: 5,260,755

[45] Date of Patent: Nov. 9, 1993

[54] TONER COLLECTING APPARATUS

[75] Inventor: Masaru Imaizumi, Osaka, Japan

[73] Assignee: Minolta Camera Kabushiki Kaisha, Osaka, Japan

[21] Appl. No.: 210,028

[22] Filed: Jun. 21, 1988

[30] Foreign Application Priority Data

Jun. 23, 1987 [JP] Japan ..... 62-156277

[51] Int. Cl.[5] ..... G03G 21/00

[52] U.S. Cl. ..... 355/298

[58] Field of Search ..... 355/3 DD, 15, 206, 298; 118/652; 177/165, 46; 310/323; 340/613, 614

[56] References Cited

U.S. PATENT DOCUMENTS

| | | | |
|---|---|---|---|
| 3,838,922 | 10/1974 | Nelson | 355/15 |
| 4,314,242 | 2/1982 | Kuru et al. | 310/323 X |
| 4,436,412 | 3/1984 | Yamagata et al. | 355/3 DD X |
| 4,436,414 | 3/1984 | Kamiyama et al. | 118/652 X |
| 4,627,716 | 12/1986 | Oka | 355/15 |
| 4,687,320 | 8/1987 | Nakanishi et al. | 355/206 |
| 4,724,462 | 2/1988 | Yamasaki et al. | 355/206 |

FOREIGN PATENT DOCUMENTS

| | | | |
|---|---|---|---|
| 0195873 | 11/1983 | Japan | 355/15 |
| 60-22173 | 2/1985 | Japan . | |
| 60-108877 | 6/1985 | Japan . | |
| 0120384 | 6/1985 | Japan | 355/15 |
| 0175072 | 9/1985 | Japan | 355/15 |
| 60-198571 | 10/1985 | Japan . | |

*Primary Examiner*—Fred L. Braun

*Attorney, Agent, or Firm*—Burns, Doane, Swecker & Mathis

[57] ABSTRACT

A toner collecting includes a toner collecting container, a support rest, a pressure sensor and a controller. As a residual toner left and removed off a photoconductive drum gradually fills the toner collecting container, the support rest moves downward to exert a load to the pressure sensor. The pressure sensor outputs voltages, varying in accordance, with the load, to the controller. Then the controller prohibits the operation of an image forming apparatus when the pressure sensor outputs voltages in compliance with the weight of the empty toner collecting container and the weight of the toner collecting container filled up with the residual toner collected. Therefore, the toner collecting apparatus can be built in a simple construction resulting in a reduced manufacturing cost and arouse an operator's attention in a reliable and understandable manner.

6 Claims, 4 Drawing Sheets

TONER COLLECTING APPARATUS

BACKGROUND OF THE INVENTION

1. Field of the Invention

This invention relates to a toner collecting apparatus for collecting a developing agent, i.e. a toner, remaining on a photoconductive member of an image forming apparatus such as an electrophotographic copying machine and a laser printer.

2. Description of the Prior Art

An image forming apparatus, like an electrophotographic copying machine and a laser printer, is equipped with a toner collecting apparatus. The toner collecting apparatus is for collecting a developing agent (hereinafter referred to as a toner) left and removed off a photoconductive drum after transferring a toner image formed on the photoconductive drum onto a plain paper.

A first example of the conventional toner collecting apparatuses is shown in FIG. 5. This toner collecting apparatus has a support plate 11 and a toner collecting container 12 placed on the support plate 11. The support plate 11 is held swingably with a shaft at one end 11*a*, and hooked to a spring 14 at the other end 11*b*. Toner removed off a photoconductive drum is transferred through a conveyor pipe 15, and collected in the toner collecting container 12. The strength of the spring 14 is so set that it brings the end 11*b* of the support plate 11 into contact with a stopper 16 till the toner collecting container 12 is filled up with the collected toner. When the toner collecting container 12 is full, the spring 14 extends and the support plate 11 inclines to a predetermined position. And when the support plate 11 inclines to the predetermined position, the support plate 11 presses and turns on a switch 13. Then, a signal is generated to display an alarm on an operation panel or to prohibit a copying operation.

This first conventional toner collecting apparatus arouses an operator's attention with the alarm display or the prohibition of copying operation when the toner collecting container 12 is substantially filled up with the collected toner. However, the alarm display or the prohibition of copying operation is not given when an operator fails to place the toner collecting container 12 on the support plate 11. Consequently, the toner collected is spilled to contaminate inside a copying apparatus.

A second example of the conventional toner collecting apparatuses is shown in FIG. 6. This toner collecting apparatus has a support rest 21 and a toner collecting container 22 made of a transparent or semitransparent material such as polyethylene and placed on the support rest 21. A photoelectric switch 23 made of a light emitting element 23*a* and a light receiving element 23*b* is disposed at the neck of the toner collecting container 22. When the toner collecting container 22 is substantially full, the photoelectric switch 23 is turned off to generate a signal for displaying an alarm on an operation panel or prohibiting a copying operation. The support rest 21 has a lever 24 having an inverted "L"-shape. And the lever 24 has a stopper 24*a* at the rear and a corner joined to a support shaft 24*b*. When the toner collecting container 22 is placed at a predetermined position, the toner collecting container 22 presses the stopper 24*a* and the lever 24 swings upward around the support shaft 24*b* from a position shown with alternate long and two dashes lines to a position shown with solid lines. The lever 24 is placed in a manner overlapping a side of the support rest 21, i.e. a position shown with the alternate long and two dashes lines, when the toner collecting container 22 is not on the support rest 21. An end 24*c* of the lever 24 protrudes slightly ahead of an end surface of the support rest 21. The end 24*c* of the lever 24 blocks and prevents a cover (not shown), which is opened and closed when replacing the toner collecting container 22, from being locked in place.

This second conventional toner collecting apparatus detects the toner collecting container 22 filled up with the collected toner with the photoelectric switch 23, and arouses an operator's attention by preventing the cover from being locked in place. However, the structure of the toner collecting apparatus becomes complicated and the manufacturing cost increases, since the detection of the toner collecting container's presence and the detection of the toner collecting container's filled up state are done with separate mechanisms independently.

SUMMARY OF THE INVENTION

It is therefore an object of this invention to provide a toner collecting apparatus having a simple structure, detecting both the presence of toner collecting container and the amount of collected toner with one sensor, and arousing an operator's attention in a reliable and understandable manner.

A toner collecting apparatus of this invention comprises a toner collecting container, a support rest, a pressure sensor and a controller. And it operates as follows: The toner collecting container is gradually filled with a residual toner left and removed of a photoconductive drum, and a load, i.e. the weight of the toner collecting container and the residual toner collected therein, is applied to the support rest to move it downward. And voltages, varying in accordance with the load, are output by the pressure sensor. When the output voltage is a value meeting the weight of the empty toner collecting container, an alarm display and an image forming operation prohibition command are given by the controller. And when the output voltage is a value meeting the weight of the toner collecting container filled up with the residual toner collected, the alarm display and the image forming operation prohibition command are again given by the controller.

Thus, the one sensor detects both the presence of toner collecting container and the amount of collected toner in this invention. Accordingly, the toner collecting apparatus of this invention can be built in a simple construction resulting in a reduced manufacturing cost. Further, it is possible to arouse a user's attention in a reliable and understandable manner, since the results of the detection of the weight of toner collecting container and collected toner are electrically processed into the alarm display or the image forming operation permission and prohibition commands in this invention.

BRIEF DESCRIPTION OF THE DRAWINGS

The above and other objects, features and advantages of this invention will become fully apparent from the following description taken in conjunction with the accompanying drawings, in which.

DESCRIPTION OF THE PREFERRED EMBODIMENT

A preferred embodiment of a toner collecting apparatus according to this invention will be hereinafter described with reference to accompanying drawings. This preferred embodiment is an application of the toner collecting apparatus to an electrophotographic copying machine.

Figure 1:
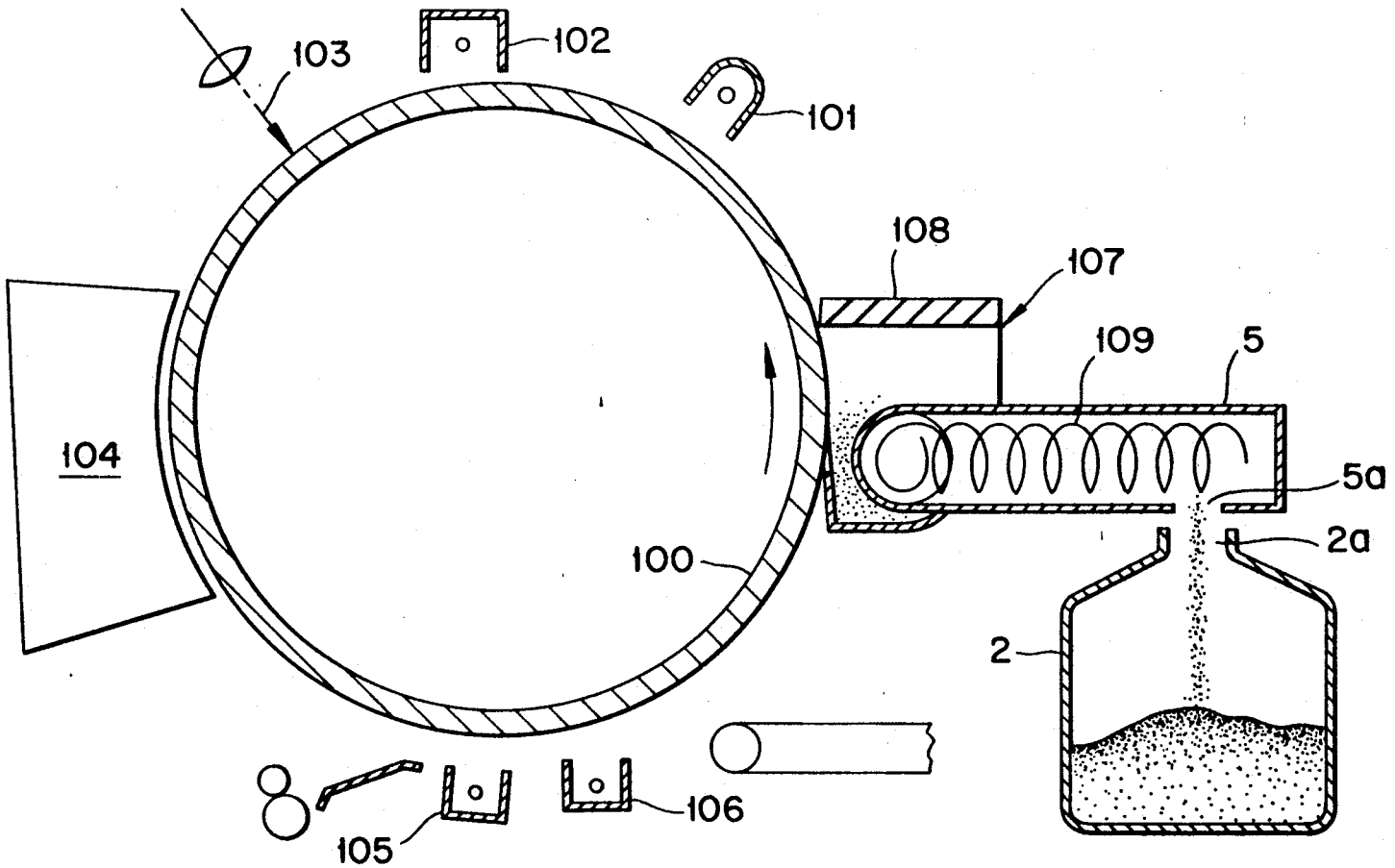
FIG. 1 is a schematic diagram of a copying machine provided with a toner collecting apparatus of this invention.

FIG. 1 shows primary components of the copying machine provided with a toner collecting container 2. Indicated at 100 is a photoconductive drum which is rotatable in the direction of arrow shown. Arranged around the drum 100 are an eraser lamp 101, a sensitizing charger 102, an image exposure station 103, a developing device 104, a transfer charger 105, a separating charger 106 and a cleaner 107 in succession. The operation of these components is well known and will not be described, while the parts resulting to the invention will be described below.

The toner remaining on the drum 100 is scraped off by a cleaning blade 108, falls into the cleaner 107 and is then transported through a conveyor pipe 5 having a conveyor coil 109 and accommodated in the toner collecting container 2 which is disposed below an opening 5*a* at one end of the pipe 5.

Figure 2:
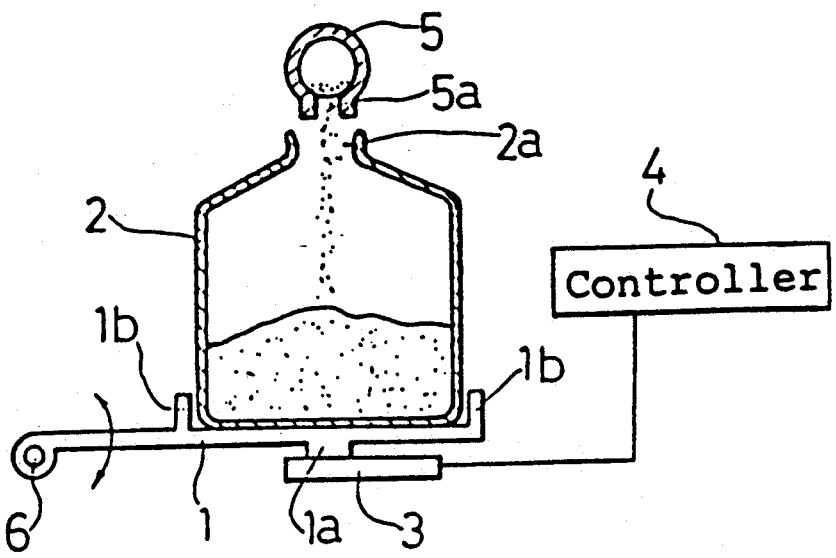
FIG. 2 is a side elevation view of a preferred embodiment of a toner collecting apparatus of this invention partly in section.

As shown in FIG. 2, the toner collecting container 2 is placed on a support rest 1 disposed in the copying machine. The support rest 1 is for holding the toner collecting container 2. It has a contact 1*a* on the bottom surface in contact with a pressure sensitive portion (not shown) of a pressure sensor 3 and a holding frame 1*b* on the top surface for holding the toner collecting container 2. It is rotatably support at one end thereof with a shaft 6 which is installed in the copying machine, and held in a substantially horizontal manner with the pressure sensor 3 which holds the contact 1*a*. Thus the support rest 1 swings in the vertical direction around the shaft 6. And it weighs 50 g.

The toner collecting container 2 is a bottle shape having an opening 2*a* at the top. It is placed detachably within the holding frame 1*b* on the support rest 1 so that the opening 2*a* is positioned under the opening 5*a* of the conveyor pipe 5. And the toner collecting container 2 weighs 75 g, and is substantially full when it is filled with 225 g of the collected toner.

Figure 3:
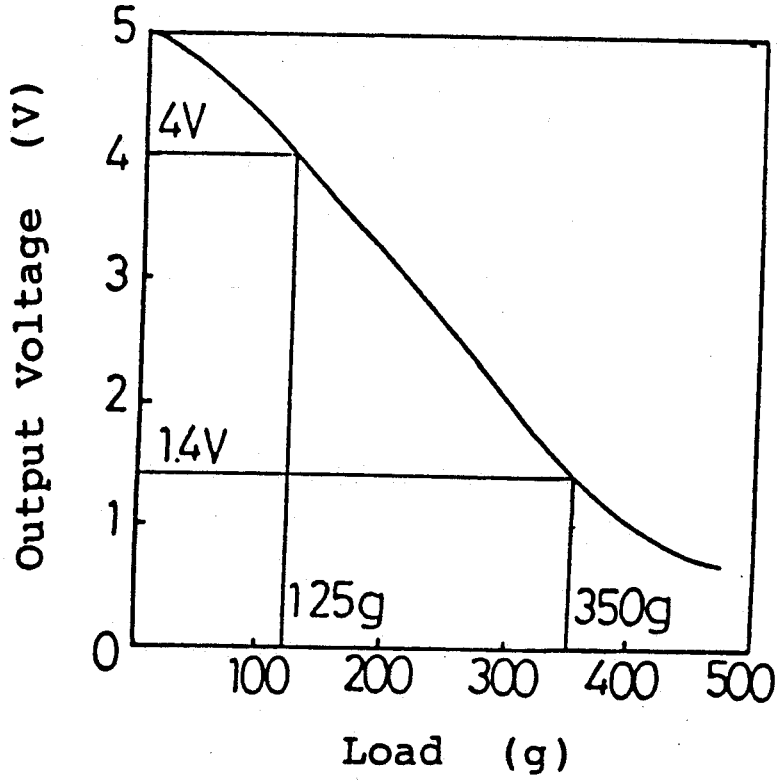
FIG. 3 is a graph showing the relationship between loads applied to a pressure sensor and output voltages employed for setting the preferred embodiment of the toner collecting apparatus of this invention.

The pressure sensor 3 is installed on a base (not shown) of the copying machine so that it is positioned under the bottom surface of the support rest 1, and is connected to the controller 4. It has the pressure sensitive portion (not shown) so positioned as to agree with the center portion of the bottom surface of the toner collecting container 2. The pressure sensor 3 detects loads applied on it and outputs voltages according to the weight detection. As shown in FIG. 3, it outputs smaller voltages as the load increases: the output voltage is 4 V when the load is 125 g, and the output is 1.4 V when the load is 350 g. In this preferred embodiment, a pressure sensitive and electrically conductive rubber manufactured by YOKOHAMA RUBBER Co. Ltd. was used as the pressure sensor 3.

The controller 4 is a microcomputer. It permits and prohibits the copying operation depending on the output voltage, i.e. the output signal, from the pressure sensor 3. And it judges that the toner collecting container 2 is not placed on the support rest 1 when the output voltage is more than 4 V, and gives an alarm display to this effect and a copying operation prohibition command. On the other hand, it judges that the toner collecting container 2 is full when the output voltage is 1.4 V or less, and gives an alarm display to this effect and a copying operation prohibition command. And it gives a copying operation permission command when the output voltage falls in the range from 1.4 V (exclusive) to 4 V (inclusive).

Figure 4:
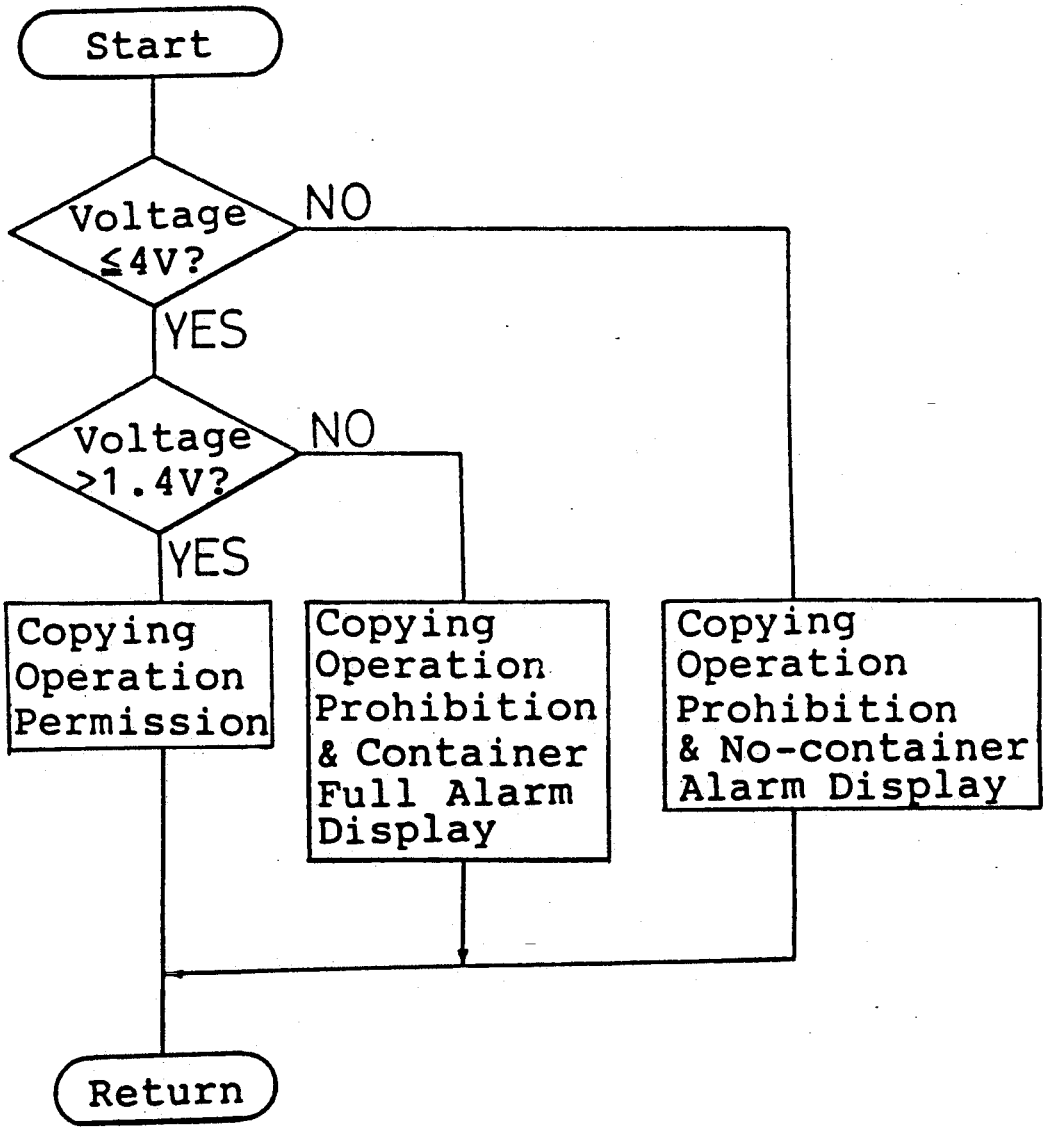
FIG. 4 is a flow chart of a program executed by a controller for controlling the preferred embodiment of the toner collecting apparatus of this invention.
Figure 5:
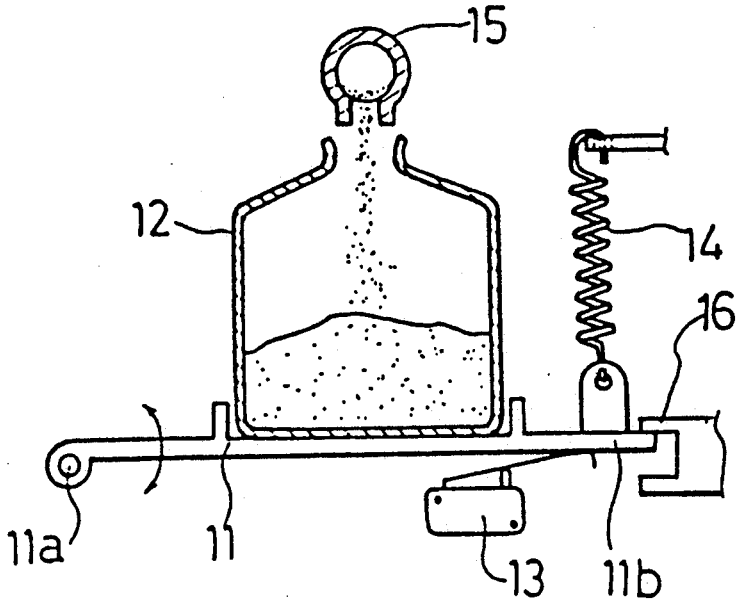
FIG. 5 (PRIOR ART)
FIG. 5 is a side elevation view of a first conventional toner collecting apparatus partly in section.
Figure 6:
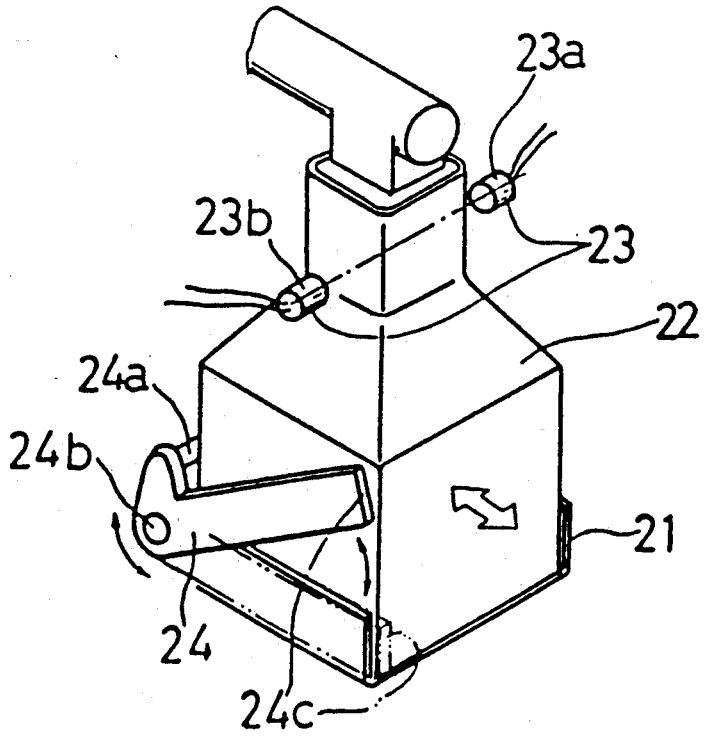
FIG. 6 (PRIOR ART)
FIG. 6 is a perspective view of a second conventional toner collecting apparatus.

The operation of the preferred embodiment of the toner collecting apparatus thus arranged will be described with reference to the flow chart shown in FIG. 4. The flow chart illustrates an output voltage judgment routine program. And this routine program is an operation process performed by the controller 4 according to the output voltage judgment.

When the copying machine is turned on, the pressure sensor 3 starts detecting the weight of the support rest 1 and the toner collecting container 2 and continues to output voltages varying according to the weight detected. The controller 4 includes a first comparator for determining whether the output voltage from the pressure sensor 3 is 4 V or less. When it judges that the output voltage is not 4 V or less, it presumes that the toner collecting container 2 is not placed on the support rest 1 and gives the alarm display to this effect and the copying operation prohibition command. Thus, a user urged with the alarm display places an empty toner collecting container 2 at a predetermined position on the support rest 1, and the pressure sensor 3 outputs the voltage of 4 V since the detected weight is not 125 g, the sum of the support rest 1 and the toner collecting container: 50 (g)+75 (g)=125 (g). On the other hand, the controller 4 also includes a second comparator for determining whether the output voltage is less than 1.4 V. When the controller 4 judges that the output voltage is 4 V or less, it then judges whether the output voltage is more than 1.4 V. When it judges that the output voltage is not more than 1.4 V, it presumes that the toner collecting container 2 is full with the collected toner and gives the alarm display to this effect and the copying operation prohibition command. Thus, a user urged with the alarm display takes out the toner collecting container 2 fully filled up with the collected toner and replaces it with an empty toner collecting container 2 to cancel the copying operation prohibition command and put the copying machine into a copying operation standby state. On the other hand, when the controller 4 judges that the output voltage is more than 1.4 V, the copying operation can be continued since no copying operation prohibition command has been given.

The copying operation is performed while the output voltage is falling in the range from 1.4 V (exclusive) to 4 V (inclusive). The toner removed off the photoconductive drum 100 is transferred through the conveyor pipe 5, and is fed into the toner collecting container 2 through the opening 5*a* and the opening 2*a*. The load applied to the pressure sensor 3 increases as the toner collecting container 2 is filled with the collected toner, and the output voltage from the pressure sensor 3 gradually decreases. And when the controller 4 judges that the output voltage 1.4 V or less, the controller 4 presumes that the toner collecting container 2 is filled up with the collected toner, and gives the alarm display to this effect and the copying operation prohibition command. And after the toner collecting container filled up with the collected toner is replaced with an empty one, this preferred embodiment of the toner collecting apparatus is operated repeatedly as described above.

The preferred embodiment of the toner collecting apparatus has the pressure sensor 3 which outputs the voltage varying in accordance with the detected weight as described above. Thus, it is possible to detect a user's failure to place the toner collecting container 2 on the support rest 1 and the toner collecting container 2 filled up with the collected toner. Accordingly, the contamination in the copying machine can be prevented without failure by giving the alarm display to these effects and prohibiting the copying operation.

This preferred embodiment is to be considered in all respects as illustrative and not restrictive, and the scope of this invention is indicated by the appended claims rather than by the foregoing description. Accordingly, this invention may be embodied in other forms without departing from the scope thereof. For instance, when the toner collecting container 2 is not on the support rest 1 and when the toner collecting container 2 is filled up with the collected toner, only the alarm display or the copying operation prohibition command may be given although both of the alarm display and the copying operation prohibition are given in this preferred embodiment. Further, the controller 4 may give a command to display the amount of the collected toner in the toner collecting container 2 gradually in addition to the alarm display and the copying operation prohibition command.

What is claimed is:

1. A toner collecting apparatus for collecting a residual toner on a photoconductive member of an image forming apparatus comprising:

a toner collecting container for collecting said residual toner and being detachably support in an image forming apparatus;

a detector for detecting the weight of said toner collecting container and said residual toner collected therein, and for outputting an electric signal which varies linearly in substantial proportion to said weight;

a first comparator for comparing the signal output by said detector with a first value corresponding to the weight of said empty toner collecting container;

a second comparator for comparing the signal output by said detector with a second value corresponding to the weight of said toner collecting container filled up with said residual toner collected; and a controller for judging that said toner collecting container is not present in an image forming apparatus when said first comparator finds that said signal output is greater than said first value and that said toner collecting container is filled up with said residual toner collected when said signal output is less than said second value.

2. A toner collecting apparatus according to claim 1, wherein said controller prohibits said operation of said image forming apparatus when said controller judges that said toner collecting container is not present in said image forming apparatus and when said controller judges that said toner collecting container is filled up with said residual toner collected.

3. A toner collecting apparatus according to claim 1, wherein said detector is a pressure sensor comprising a pressure sensitive and electrically conductive rubber.

4. A toner collecting apparatus for collecting a residual toner on a photoconductive member of an image forming apparatus comprising:

a toner collecting container for collecting said residual toner detachably disposed in an image forming apparatus;

a support rest for supporting said toner collecting container thereon and which can be displaced in accordance with the weight of said toner collecting container and said residual toner collected therein;

a pressure sensor provided on the under surface of said support rest for outputting an electrical signal varying linearly in proportion to the amount of the displacement of said support rest which is subjected to the load exerted by the weight of said toner collecting container and said residual toner collected therein;

a first comparator for comparing said electric signal output from said pressure sensor with a first value corresponding to the weight of said empty toner collecting container;

a second comparator for comparing said electric signal output from said pressure sensor with a second value corresponding to the weight of said toner collecting container filled up with said residual toner collected; and a judging means for judging whether said toner collecting container is present in said image forming apparatus and whether said toner collecting container is filled up with said residual toner collected depending on comparison results made by said first and second comparators.

5. A toner collecting apparatus according to claim 4 further comprising: an image forming operation prohibiting means for prohibiting the operation of said image forming apparatus when said judging means judges that said toner collecting container is not present in said image forming apparatus and when said judging means judges that said toner collecting container is filled up with said residual toner collected.

6. A toner collecting apparatus according to claim 4, wherein said pressure sensor is comprised of a pressure sensitive and electrically conductive rubber.

* * * * *